US011364403B2

(12) United States Patent
Hsu

(10) Patent No.: US 11,364,403 B2
(45) Date of Patent: Jun. 21, 2022

(54) EXERCISE MACHINE AND DUAL RESISTANCE STRUCTURE COMBINING WIND RESISTANCE AND MAGNETIC RESISTANCE THEREOF

(71) Applicant: GREAT FITNESS INDUSTRIAL CO., LTD., Tainan (TW)

(72) Inventor: Chih-Yung Hsu, Tainan (TW)

(73) Assignee: Great Fitness Industrial Co., Ltd., Tainan (TW)

( * ) Notice: Subject to any disclaimer, the term of this patent is extended or adjusted under 35 U.S.C. 154(b) by 0 days.

(21) Appl. No.: 16/890,410

(22) Filed: Jun. 2, 2020

(65) Prior Publication Data

US 2021/0370125 A1 Dec. 2, 2021

(51) Int. Cl.

| | |
|---|---|
| ***A63B 21/00*** | (2006.01) |
| ***A63B 22/06*** | (2006.01) |
| ***A63B 21/008*** | (2006.01) |

(52) U.S. Cl.

CPC .. *A63B 21/00192* (2013.01); *A63B 21/00069* (2013.01); *A63B 21/0088* (2013.01); *A63B 22/0605* (2013.01)

(58) Field of Classification Search

CPC ..... A63B 21/00192; A63B 21/0088; A63B 21/00069; A63B 22/0605; A63B 22/0076; A63B 22/02; A63B 22/0228; A63B 22/0235; A63B 22/04; A63B 22/06; A63B 22/0664

See application file for complete search history.

(56) References Cited

U.S. PATENT DOCUMENTS

| | | | | |
|---|---|---|---|---|
| 5,051,638 | A * | 9/1991 | Pyles | A63B 21/0051 310/105 |
| 9,199,115 | B2 * | 12/2015 | Yim | A63B 21/4035 |
| 9,945,383 | B2 * | 4/2018 | Wang | A63B 21/0051 |
| 10,112,067 | B2 * | 10/2018 | Golesh | A63B 21/0051 |
| 10,155,132 | B2 * | 12/2018 | Jones | A63B 22/0605 |
| 10,300,321 | B2 * | 5/2019 | Hsu | A63B 22/001 |

(Continued)

FOREIGN PATENT DOCUMENTS

| | | |
|---|---|---|
| TW | M511345 U | 11/2015 |
| TW | I636810 B | 10/2018 |
| TW | I651114 B | 2/2019 |

*Primary Examiner* — Megan Anderson
(74) *Attorney, Agent, or Firm* — Rosenberg, Klein & Lee

(57) ABSTRACT

A dual resistance structure includes a rotating shaft, a wind resistance unit, and a magnetic resistance unit. The wind resistance unit is fixed to the rotating shaft and includes blades arranged annularly. The magnetic resistance unit includes a magnetic resistance member and a magnetic resistance wheel. The magnetic resistance wheel is fixed to the rotating shaft. The magnetic resistance wheel is spaced apart from the wind resistance unit by a distance in an axial direction of the rotating shaft to form a moving space. The magnetic resistance member is selectively moved into or away from the moving space in a radial direction of the magnetic resistance wheel to adjust a magnetic resistance of the magnetic resistance wheel. Part of the magnetic resistance member is movable in the moving space when the magnetic resistance member is moved in the radial direction. The dual resistance structure is mounted on an exercise machine.

7 Claims, 9 Drawing Sheets

(56) References Cited

U.S. PATENT DOCUMENTS

| | | | | |
|---|---|---|---|---|
| 10,639,512 | B2 * | 5/2020 | Huang | A63B 21/0056 |
| 10,814,154 | B2 * | 10/2020 | Wang | A63B 21/005 |
| 2016/0153852 | A1 * | 6/2016 | Wu | A63B 21/0051 73/862.332 |
| 2018/0256932 | A1 * | 9/2018 | Hsu | A63B 22/06 |

* cited by examiner

EXERCISE MACHINE AND DUAL RESISTANCE STRUCTURE COMBINING WIND RESISTANCE AND MAGNETIC RESISTANCE THEREOF

FIELD OF THE INVENTION

The present invention relates to an exercise machine and a dual resistance structure combining wind resistance and magnetic resistance thereof. Through a moving space between a wind resistance unit and a magnetic resistance unit, a magnetic resistance member of the magnetic resistance unit is selectively moved in a radial direction of a magnetic resistance wheel of the magnet resistance unit to adjust a magnetic resistance of the magnetic resistance wheel. When the magnetic resistance member is moved in the radial direction, part of the magnetic resistance member is movable in the moving space.

BACKGROUND OF THE INVENTION

Taiwan Patent Publication No. 1636810 discloses a magnetic resistance adjustment device of a wind resistance exercise bike. The exercise bike is provided with a traction cable. The exercise bike comprises a resistance wheel, a magnetic resistance ring, a fixing member, and a displacement member. The resistance wheel has blades for generating wind resistance and is installed on the exercise bike. The resistance wheel has a wheel body and a wheel shaft. The wheel shaft is installed on the wheel body. The magnetic resistance ring is installed on the resistance wheel. The fixing member is installed on the wheel shaft. A positioning bolt is provided on the fixing member. The direction in which the fixing member extends to the magnetic resistance ring is defined as a displacement direction. The displacement member has a displacement hole, a fixing portion, and a magnetic resistance portion. The displacement hole allows the positioning bolt to be inserted therein, so that the displacement member can be displaced back and forth in the displacement direction for the magnetic resistance portion to be moved toward or away from the magnetic resistance ring. The fixing portion is driven by and connected with the traction cable.

In the above-mentioned patent, although the combination of the wind resistance unit and the magnetic resistance unit enhances the exercise effect of the sports device, the wind resistance unit is installed and fixed on the resistance wheel of the magnetic resistance unit. Due to the space limitation of the device, the blades of the wind resistance unit are too short, and the wind resistance generated by the wind resistance unit is too small.

Taiwan Patent Publication No. 1651114 discloses a resistance adjustment device combining wind resistance and magnetic resistance. The resistance adjustment device is installed on a support and includes a rotating unit, a magnetic resistance unit and a wind resistance unit. The rotating unit includes a mandrel, a coupling block, and a magnetic rotating wheel. The mandrel is rotatably installed on the support. The coupling block is fixed to the mandrel. The magnetic rotating wheel is detachably connected to the coupling block. The magnetic resistance unit is movably disposed on the support and includes an adjustment seat and a plurality of magnetic members. The adjustment seat is movably disposed on the support. The magnetic member is arranged on the adjustment seat. The wind resistance unit is detachably disposed on the outer side of the magnetic rotating wheel.

In the above-mentioned patent, although the combination of the wind resistance unit and the magnetic resistance unit enhances the exercise effect of the sports device, the wind resistance unit is installed on the magnetic rotating wheel. In order to avoid hindering the adjustment seat from carrying the magnetic member toward the magnetic rotating wheel to adjust the magnetic resistance, the magnetic rotating wheel needs to be larger than the wind resistance unit. As a result, the length of the blades of the wind resistance unit is limited, and the wind resistance generated is too small.

Taiwan Utility Model Publication No. M511345 discloses a fan damping device with an adjustable magnetic resistance. The fan damping device comprises a support frame, a fan rotating wheel, a magnetic induction ring, and a magnetic control unit. The fan rotating wheel is rotatably disposed on the support frame. The fan rotating wheel includes a central disc portion and a plurality of extending necks. One end of each extending neck is integrally formed with the periphery of the central disc portion, and the other end of each extending neck is twisted to form a blade. The magnetic induction ring is fixedly disposed on the central disc portion. The magnetic induction ring is made of a material that can be attracted by magnetic attraction. The magnetic control unit includes a path limit member and a magnetic control assembly. The path limit member is fixedly disposed on the support frame. The path limit member defines an arc-shaped limit opening. The magnetic control assembly includes a magnet seat and a plurality of magnets. One end of the magnet seat is a pivot end, and the other end is an outer end. The magnet seat has a first surface and an opposing second surface. A controlled portion is provided between the two ends of the magnet seat and extends in a direction away from the second surface. The first surface of the magnet seat faces the path limit member, and the pivot end is pivotally coupled to the path limit member. The magnets are arranged on the second surface of the outer end of the magnet seat.

In the above-mentioned patent, although the combination of the wind resistance unit and the magnetic resistance unit enhances the exercise effect on the sports device, the magnetic control assembly is moved toward the magnetic induction ring from the side to adjust the resistance. The unilateral magnetic resistance has a limited effect in adjusting the magnetic resistance. Besides, the magnets of the magnetic control assembly act on the magnetic induction ring on one side, so that the magnetic induction ring is stressed on one side, causing the center disc portion to be deformed.

Accordingly, the inventor of the present invention has devoted himself based on his many years of practical experiences to solve these problems.

SUMMARY OF THE INVENTION

According to one aspect of the present invention, a dual resistance structure combining wind resistance and magnetic resistance is provided. The dual resistance structure comprises a rotating shaft, a wind resistance unit, and a magnetic resistance unit. The wind resistance unit is fixed to the rotating shaft and includes a plurality of blades arranged annularly. The magnetic resistance unit includes a magnetic resistance member and a magnetic resistance wheel. The magnetic resistance wheel is fixed to the rotating shaft. The magnetic resistance wheel is spaced apart from the wind resistance unit by a distance in an axial direction of the rotating shaft to form a moving space. The magnetic resistance member is selectively moved into or away from the moving space in a radial direction of the magnetic resistance wheel to adjust a magnetic resistance of the magnetic resistance wheel. Part of the magnetic resistance member is movable in the moving space when the magnetic resistance member is moved in the radial direction.

According to another aspect of the present invention, an exercise machine having a dual resistance structure combining wind resistance and magnetic resistance is provided. The exercise machine comprises an exercise machine body, a rotating shaft, a wind resistance unit, and a magnetic resistance unit. The exercise machine body has a control unit. The rotating shaft is disposed on the exercise machine body. The wind resistance unit is fixed to the rotating shaft and includes a plurality of blades arranged annularly. The magnetic resistance unit includes a magnetic resistance member and a magnetic resistance wheel. The magnetic resistance wheel is fixed to the rotating shaft. The magnetic resistance member is pivotally connected to the exercise machine body and connected to the control unit. The magnetic resistance wheel is spaced apart from the wind resistance unit by a distance in an axial direction of the rotating shaft to form a moving space. The magnetic resistance member is selectively moved into or away from the moving space in a radial direction of the magnetic resistance wheel to adjust a magnetic resistance of the magnetic resistance wheel. Part of the magnetic resistance member is movable in the moving space when the magnetic resistance member is moved in the radial direction.

Preferably, the magnetic resistance member includes a first portion, an opposing second portion, and a connecting portion connecting the first portion and the second portion. A groove is defined among the first portion, the second portion and the connecting portion. The first portion or/and the second portion is provided with a magnetic member. The second portion is movable in the moving space when the groove is selectively moved into or out of the magnetic resistance wheel.

Preferably, the wind resistance unit includes a turning disc. The turning disc is fixed to the rotating shaft. The blades are fixed to the turning disc. The blades extend in the radial direction beyond the magnetic resistance wheel.

Preferably, the turning disc has a diameter less than that of the magnetic resistance wheel.

Preferably, a periphery of the turning disc has a plurality of engaging grooves each recessed in the radial direction. Each of the blades has a coupling end. The coupling end has an L-shaped notch and a fixing piece extending from a periphery of the L-shaped notch. The L-shaped notch and the fixing piece are formed by stamping. Each of the blades further has an engaging block extending in the radial direction. The fixing piece of each of the blades is locked to the turning disc. The engaging block is engaged in the engaging groove, so that the each of the blades is fixed to the turning disc.

According to the above technical features, the following effects can be achieved:

1. The magnetic resistance member of the present invention includes a first portion, a second portion, and a connecting portion. A groove is defined among the first portion, the second portion and the connecting portion. The first portion or/and the second portion is provided with a magnetic member. A moving space is defined between the wind resistance unit and the magnetic resistance unit. The second portion of the magnetic resistance member is freely movable in the moving space when the magnetic resistance member is selectively moved in a radial direction of the magnetic resistance wheel. In this way, because the magnetic resistance unit and the wind resistance unit are juxtaposed on the rotating shaft, the first portion and the second portion of the magnetic resistance member can still be approached or separated from both sides of the magnetic resistance wheel simultaneously, completely unaffected by the wind resistance unit. If both the first portion and the second portion of the magnetic resistance member are provided with magnetic members, the symmetrical magnetic members enables the magnetic resistance wheel to obtain a balanced magnetic resistance, and the magnetic resistance wheel is less likely to be deformed.

2. The diameter of the rotating disc is less than the diameter of the magnetic resistance wheel, and the blades extend outwardly beyond the magnetic resistance disc. With the longer blades, the resistance of the wind resistance unit when rotated is greater, so as to achieve an exercise effect through wind resistance.

3. In this invention, the rotating disc has an engaging groove. Each of the blades has a coupling end. The coupling end has a fixing piece extending radially. The coupling end is axially engaged in the engaging groove. The blade is fixed in both radial and axial directions, so that the blade is not easy to fall when the wind resistance unit is rotated.

DESCRIPTION OF THE PREFERRED EMBODIMENTS

Embodiments of the present invention will now be described, by way of example only, with reference to the accompanying drawings.

Figure 1:
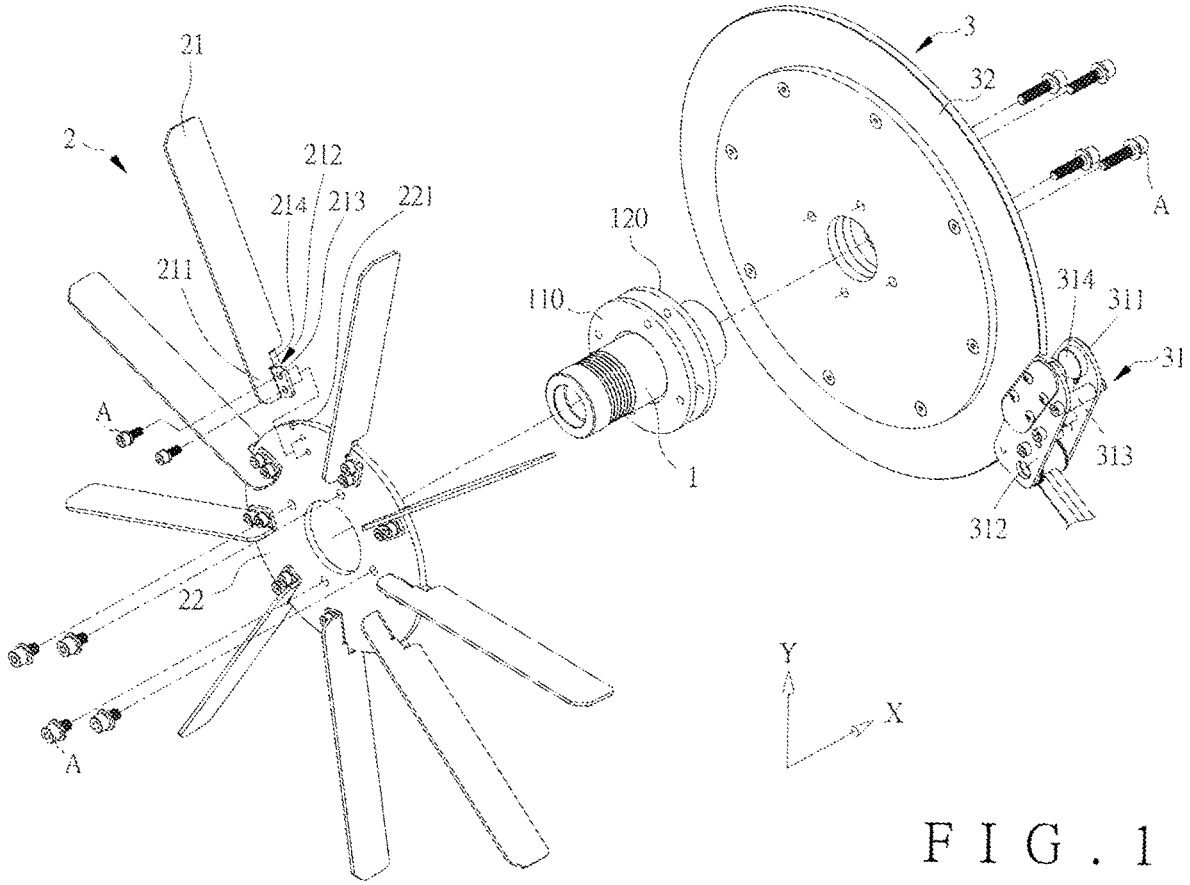
FIG. 1 is an exploded view of the dual resistance structure combining wind resistance and magnetic resistance of the present invention.
Figure 2:
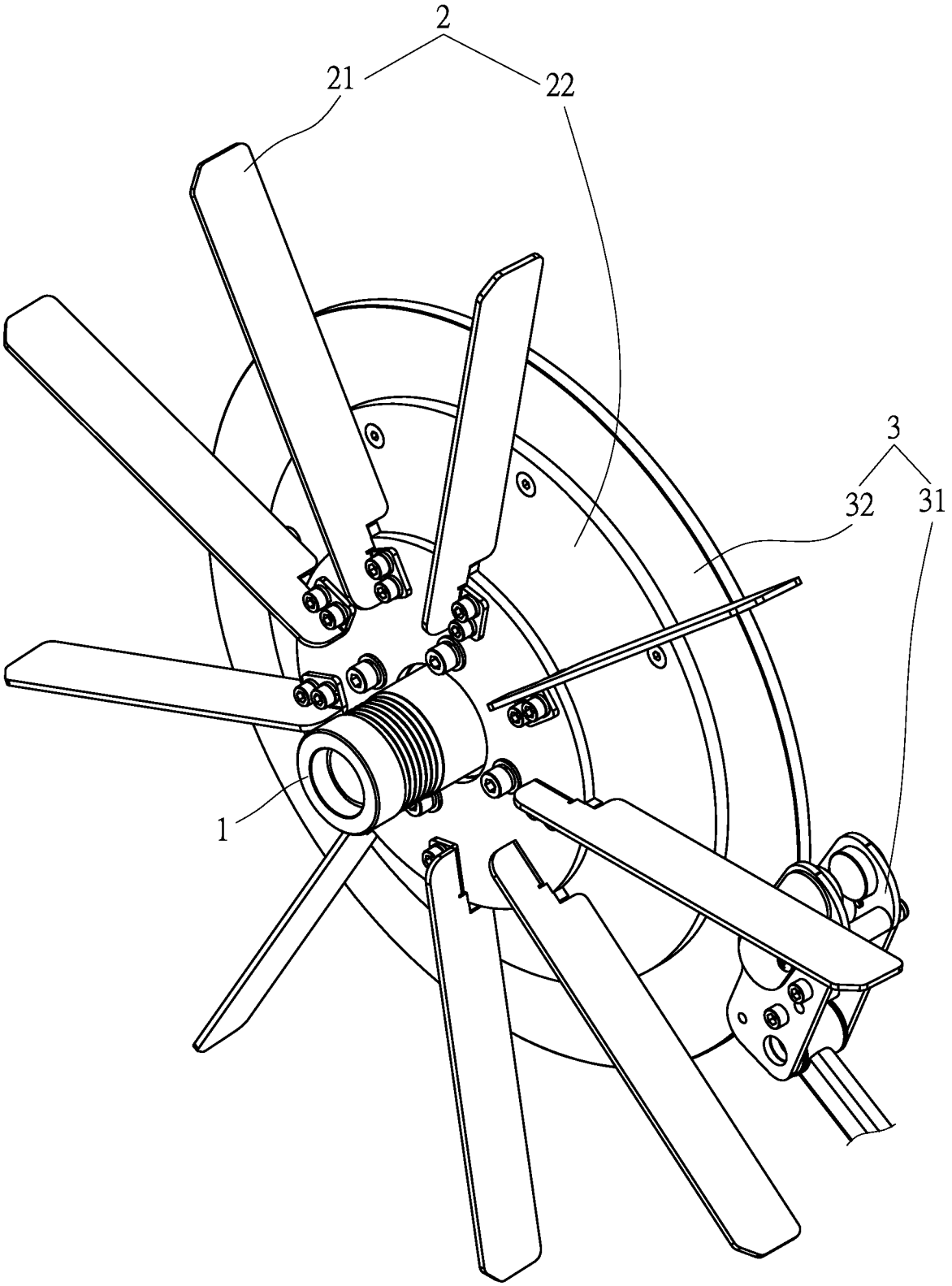
FIG. 2 is a perspective view of the dual resistance structure combining wind resistance and magnetic resistance of the present invention.
Figure 3:
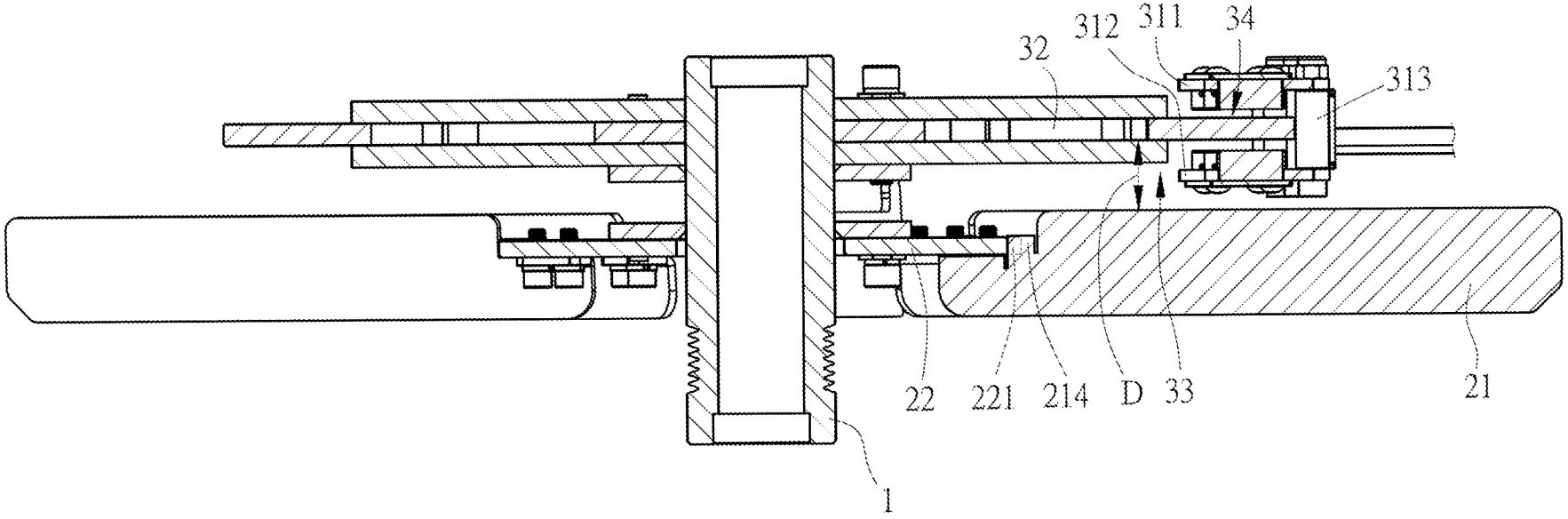
FIG. 3 is a cross-sectional view of the dual resistance structure combining wind resistance and magnetic resistance of the present invention.

As shown in FIG. 1 through FIG. 3, the present invention discloses a dual resistance structure combining wind resistance and magnetic resistance comprises a rotating shaft 1, a wind resistance unit 2, a magnetic resistance unit 3, and a plurality of screws A. The rotating shaft 1 rotates about an axial direction X, and includes a first mounting plate 110 and a second mounting plate 120 affixed to the rotating shaft 1 in axially-spaced relationship, as shown in FIG. 1. The wind resistance unit 2 includes a turning disc 22. The turning disc 22 is locked to the first mounting plate 110 of the rotating shaft 1 with the screws A, as shown in FIG. 1. The periphery of the turning disc 22 has a plurality of engaging grooves each recessed in a radial direction Y. The wind resistance unit 2 further includes a plurality of blades 21 arranged annularly. The blades 21 extend in the radial direction Y. Each of the blades 21 has a coupling end 211. The coupling end 211 has an L-shaped notch 212 and a fixing piece 213 extending from the periphery of the L-shaped notch 212. The L-shaped notch and the fixing piece 213 are formed by stamping. Each of the blades 21 further has an engaging block 214 extending in the radial direction Y. The fixing piece 213 of each of the blades 21 is connected to the turning disc 22 by the screw A, and the engaging block 214 is engaged in the engaging groove 221, so that the each of the blades 21 is fixed to the turning disc 22. The magnetic resistance unit 3 includes a magnetic resistance member 31 and a magnetic resistance wheel 32. The magnetic resistance wheel 32 is locked to the second mounting plate 120 of the rotating shaft 1 with the screws A, as shown in FIG. 1. All the blades 21 extend in the radial direction Y beyond the magnetic resistance wheel 32. The diameter of the turning disc 22 is less than the diameter of the magnetic resistance wheel 32. The magnetic resistance wheel 32 is spaced apart from the wind resistance unit 2 by a distance D in the axial direction X of the rotating shaft 1 to form a moving space 33. The magnetic resistance member 31 includes a first portion 311, an opposing second portion 312, and a connecting portion 313 connecting the first portion 311 and the second portion 312. A groove 34 is defined among the first portion 311, the second portion 312 and the connecting portion 313. The first portion 311 or/and the second portion 312 is provided with a magnetic member 314. In this embodiment, the magnetic member 314 is provided on both the first portion 311 and the second portion 312. For example, the magnetic member 314 is three permanent magnets provided on the first portion 311 and the second portion 312. The magnetic members 314 of the first portion 311 and the second portion 312 correspond to each other. The first portion 311 and the second portion 312 of the magnetic resistance member 31 can be moved synchronously in the radial direction Y of the magnetic resistance wheel 32. The second portion 312 is movable in the moving space 33, so that the magnetic resistance member 31 is selectively moved into or away from the magnetic resistance wheel 32 to adjust a magnetic resistance of the magnetic resistance wheel 32.

Figure 4:
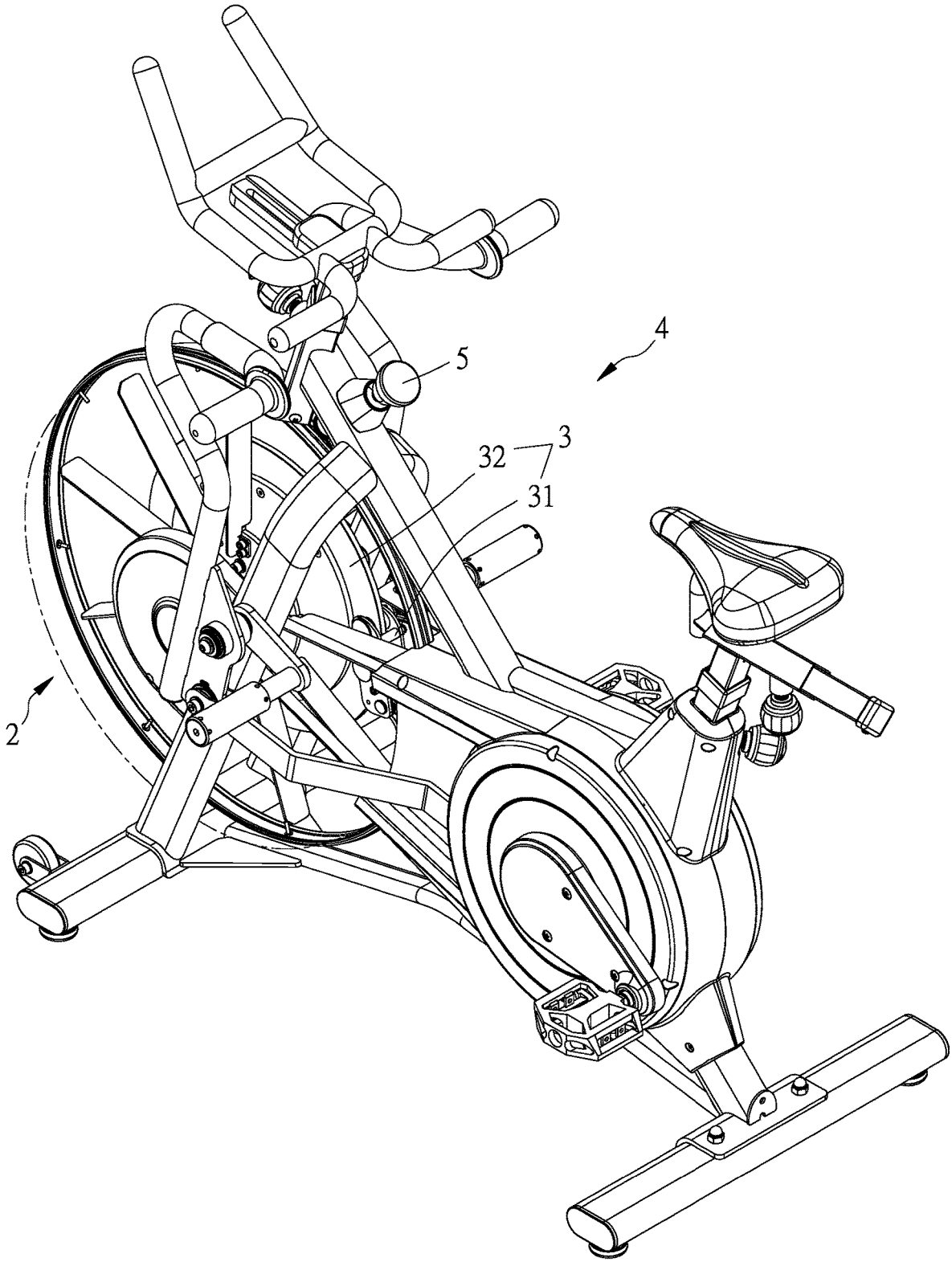
FIG. 4 is a perspective view of the exercise machine having an dual resistance structure combining wind resistance and magnetic resistance of the present invention.
Figure 5:
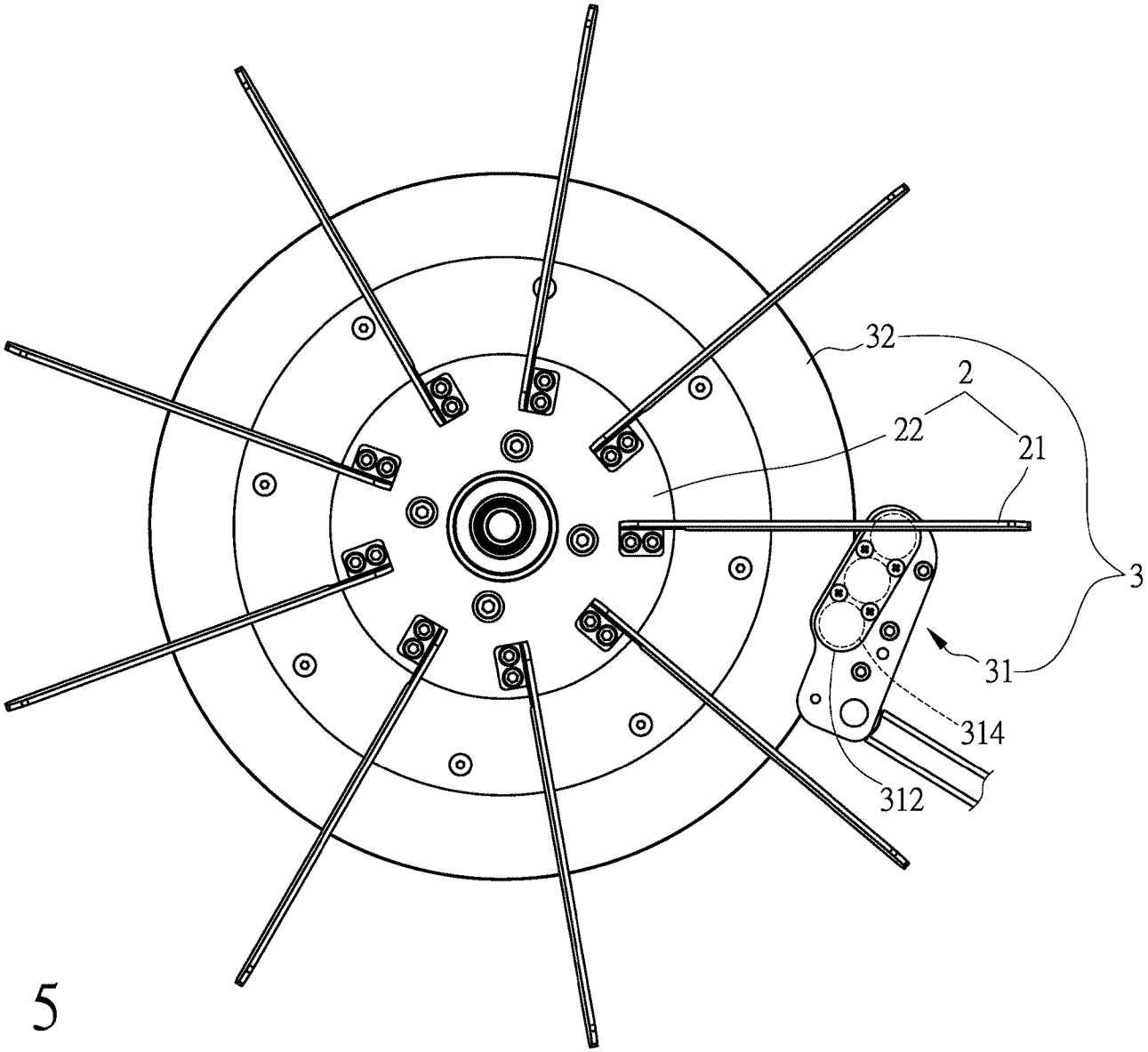
FIG. 5 is a side view of the dual resistance structure combining wind resistance and magnetic resistance of the present invention.
Figure 5A:
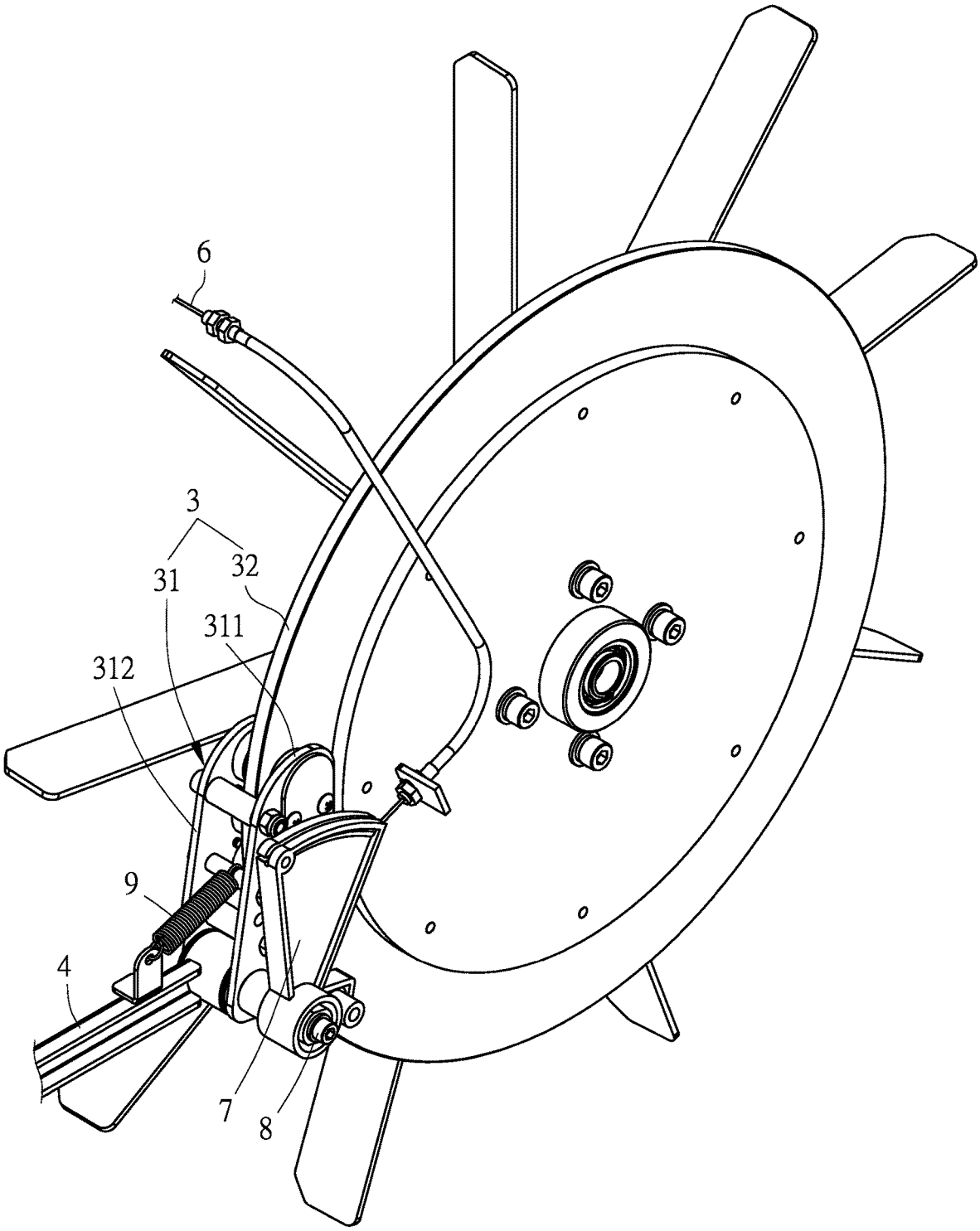
FIG. 5A is another perspective view of the dual resistance structure combining wind resistance and magnetic resistance of the present invention.

As shown in FIG. 4 and FIG. 5A, the present invention further discloses an exercise machine. The dual resistance structure combining wind resistance with magnetic resistance is mounted on an exercise machine body 4. The exercise machine further includes a control unit 5. The control unit 5 is fixed on the exercise machine body 4. The control unit 5 is configured to operate the magnetic member 31 through a cable 6. The magnetic resistance member 31 is pivotally connected to the exercise machine body 4.

Figure 6:
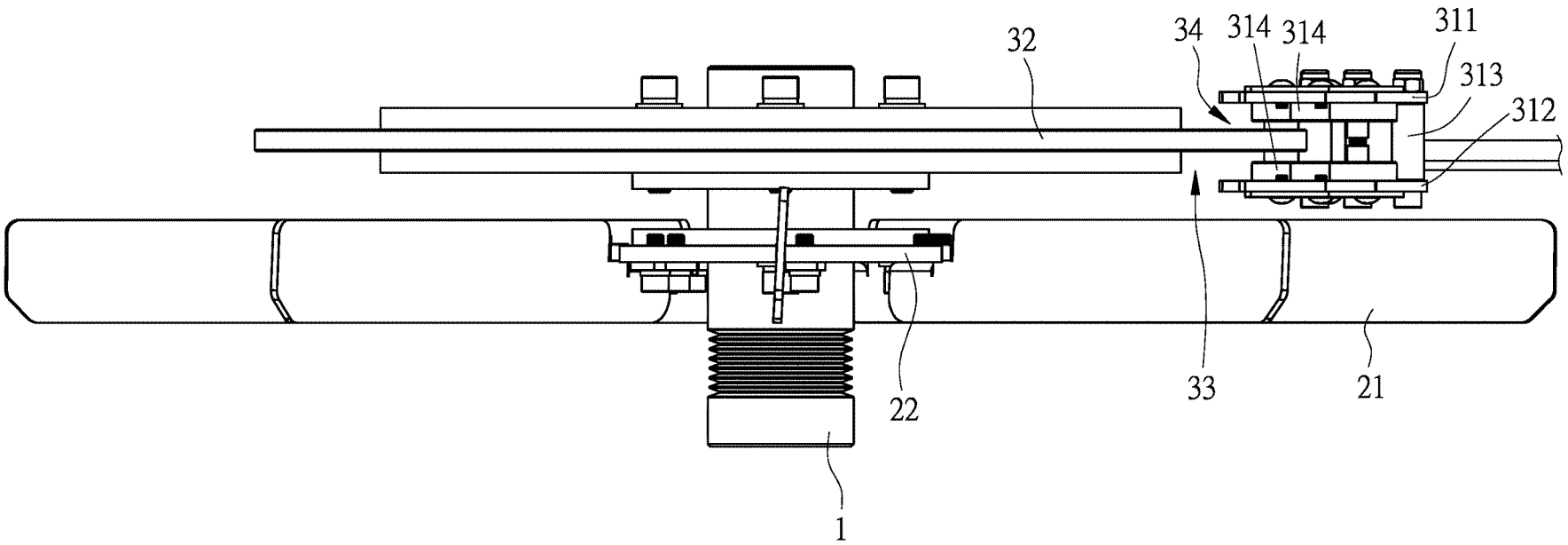
FIG. 6 is a top view of the dual resistance structure combining wind resistance and magnetic resistance of the present invention.

For the wind resistance structure, please refer to FIG. 5 and FIG. 6. When the rotating shaft 1 rotates, the rotating disc 22 and the magnetic resistance wheel 32 are driven to rotate, and the blades 21 on the rotating disc 22 are rotated to generate a wind resistance. The magnitude of the wind resistance will be affected by the size of the blades 21. The blades 21 extend outwardly beyond the magnetic resistance wheel 32. Because the length of the blades 21 is long, the resistance generated by rotation of the wind resistance unit 2 is large, thereby providing an exercising effect through the wind resistance.

For the magnetic resistance structure, please refer to FIG. 5, FIG. 5A, and FIG. 6. The control unit 5 pulls a driving block 7 through the cable 6. One end of the cable 6 is connected to the driving block 7, and the other end of the cable 6 is connected to the control unit 5. (The control unit 5 is not shown in FIG. 5A). The driving block 7 is fixed to a shaft member 8. The shaft member 8 is rotatably pivotally connected to the exercise machine body 4. The magnetic resistance member 31 is also fixed to the shaft member 8, so that the magnetic resistance member 31 and the driving block 7 are rotated synchronously with the shaft member 8 as the axis. Furthermore, a spring 9 is disposed between the exercise machine body 4 and the magnetic resistance member 31 to provide the magnetic resistance member 31 a return elastic force. Through the cable 6 to pull the driving block 7, the magnetic resistance member 31 and the driving block 7 are moved synchronously to approach magnetic resistance wheel 32 with the shaft 8 as the axis, and the spring 9 is stretched. If the cable 6 is released, the spring 9 will pull the magnetic resistance member 31 and the driving block 7 away from the magnetic resistance wheel 32 synchronously. When the magnetic resistance member 31 of the magnetic resistance unit 3 is moved toward the magnetic resistance wheel 32, the second portion 312 of the magnetic resistance member 31 moves freely in the moving space 33, and the magnetic resistance wheel 32 is located in the groove 34. In the state shown FIG. 5 and FIG. 6, only part of the magnetic member 314 is moved into the magnetic resistance wheel 32. At this time, the magnetic resistance of the magnetic resistance wheel 32 is smaller.

Figure 7:
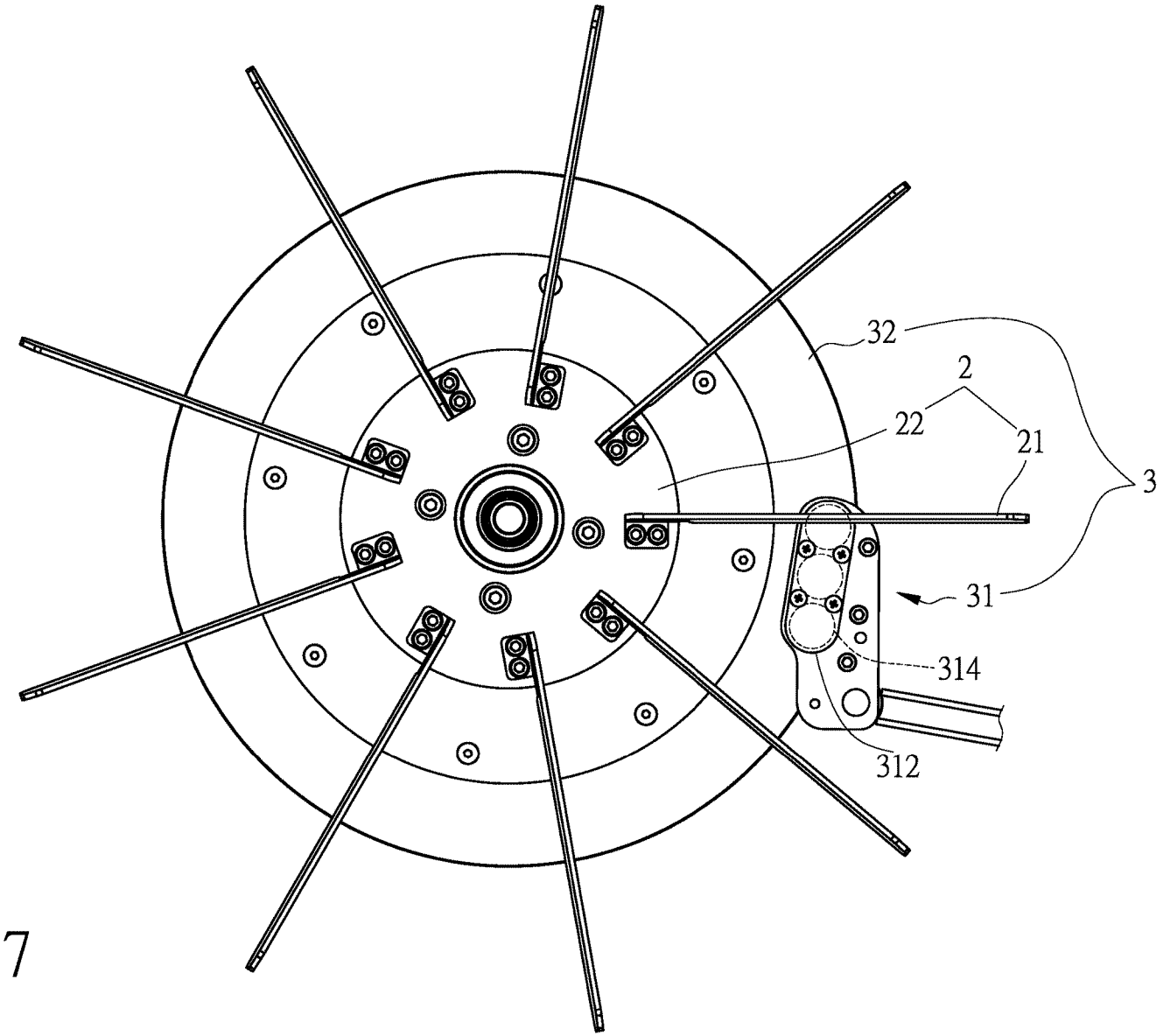
FIG. 7 is a side view illustrating the magnetic resistance member being operated to enter the moving space when in use.
Figure 8:
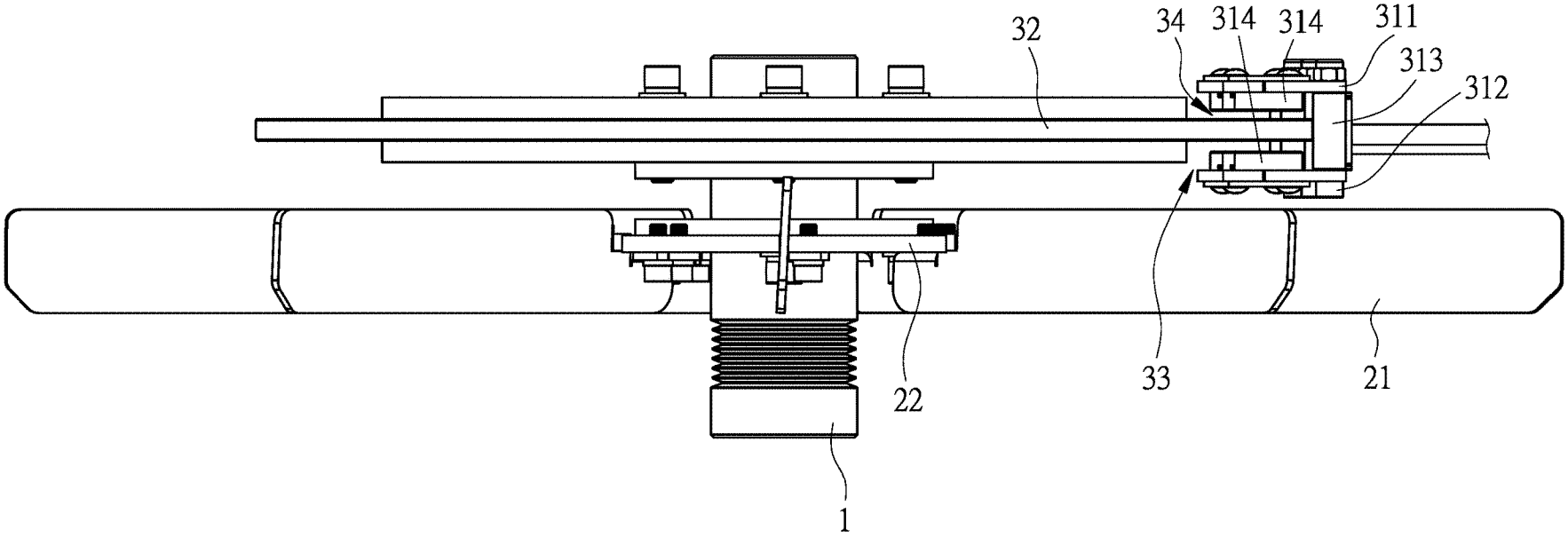
FIG. 8 is a top view illustrating the magnetic resistance member being operated to enter the moving space when in use.

Please refer to FIG. 5A, FIG. 7 and FIG. 8. When it is necessary to increase the magnetic resistance, the magnetic resistance member 31 is pulled by the cable 6, and the magnetic resistance member 31 is moved in the radial direction Y (as shown in FIG. 1) toward the magnetic resistance wheel 32. At this time, the second portion 312 of the magnetic resistance member 31 is still movable in the moving space 33 freely. In the state shown in FIG. 7 and FIG. 8, all the magnetic members 314 are moved into the area where the magnetic resistance wheel 32 is located. Tt this time, the magnetic resistance of the magnetic resistance wheel 32 is larger. When it is necessary to reduce the magnetic resistance, the cable 6 can be released, so that the spring 9 pulls the magnetic resistance member 31 and the driving block 7 away from the magnetic resistance wheel 32 synchronously, and part of the magnetic member 314 leaves the area where the magnetic resistance wheel 32 is located to reduce the magnetic resistance.

Referring to FIG. 4, when the user performs training on the exercise machine body 4, he/she can step on the pedals of exercise machine body 4 to rotate the rotating shaft 1 for exercise. The control unit 5 controls the magnetic resistance unit 3 to operate as described above, so as to adjust the resistance during training.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A dual resistance structure combining wind resistance and magnetic resistance, comprising:

a rotating shaft, and a first mounting plate and a second mounting plate affixed to the rotating shaft in axially-spaced relationship;

a wind resistance unit including a turning disc fixed to the first mounting plate of the rotating shaft and including a plurality of blades arranged annularly thereon, the plurality of blades being fixed to the turning disc; and a magnetic resistance unit including a magnetic resistance member and a magnetic resistance wheel, the magnetic resistance member including a first portion, an opposing second portion, and a connecting portion connecting the first portion and the second portion, the magnetic resistance wheel being fixed to the second mounting plate of the rotating shaft, wherein a diameter of the turning disc is lesser than a diameter of the magnetic resistance wheel, the plurality of blades of the wind resistance unit extending in the radial direction beyond the magnetic resistance wheel, the magnetic resistance wheel being spaced apart from the wind resistance unit by a distance in the axial direction of the rotating shaft to form an open moving space between the wind resistance unit and the magnetic resistance wheel, the open moving space being unobstructed during rotation of the magnetic resistance wheel, and the second portion of the magnetic resistance member being thereby selectively moveable into or away from the open moving space in an arcuate path intersecting a perimeter portion of the magnetic resistance wheel to adjust a magnetic resistance of the magnetic resistance wheel, wherein the second portion of the magnetic resistance member is in direct-adjacent relationship with respect to the plurality of blades of the wind resistance unit.

2. The dual resistance structure combining wind resistance and magnetic resistance as claimed in claim 1, wherein a groove is formed on either one of the first portion or the second portion of the magnetic resistance member, either one of the first portion or the second portion is provided with a magnetic member, and the second portion is movable in the open moving space when the groove is selectively moved into or out of the magnetic resistance wheel.

3. The dual resistance structure combining wind resistance and magnetic resistance as claimed in claim 1, wherein a periphery of the turning disc has a plurality of engaging grooves each of which is recessed in the radial direction, each of the plurality of blades has a coupling end, the coupling end has an L-shaped notch and a fixing piece extending from a periphery of the L-shaped notch, the L-shaped notch and the fixing piece are formed by stamping, each of the plurality of blades further has an engaging block extending in the radial direction, the fixing piece of each of the plurality of blades is locked to the turning disc, and the engaging block of each of the plurality of blades is engaged in the respective engaging groove, each of the plurality of blades is thereby fixed to the turning disc.

4. The dual resistance structure combining wind resistance and magnetic resistance as claimed in claim 1, wherein the first portion and the second portion of the magnetic resistance member each having at least one magnetic member, and wherein the magnetic resistance member is pivotally connected relative to the magnetic resistance wheel at a position spaced from a perimeter of the magnetic resistance wheel, the magnetic resistance member is thereby pivoted to change an overlaying surface area of the at least one magnetic member of the first and second portions with respect to the magnetic resistance wheel to thereby vary a magnetic braking effect.

5. An exercise machine having a dual resistance structure combining wind resistance and magnetic resistance, comprising:

an exercise machine body having a control unit;

a rotating shaft disposed on the exercise machine body, and a first mounting plate and a second mounting plate affixed to the rotating shaft in axially-spaced relationship;

a wind resistance unit including a turning disc fixed to the first mounting plate of the rotating shaft and including a plurality of blades arranged annularly thereon, the plurality of blades being fixed to the turning disc; and a magnetic resistance unit including a magnetic resistance member and a magnetic resistance wheel, the magnetic resistance member including a first portion, an opposing second portion, and a connecting portion connecting the first portion and the second portion, and the first and second portions each having at least one magnetic member, the magnetic resistance wheel being fixed to the second mounting plate of the rotating shaft, wherein a diameter of the turning disc is lesser than a diameter of the magnetic resistance wheel, the plurality of blades of the wind resistance unit extending in the radial direction beyond the magnetic resistance wheel, the magnetic resistance member being pivotally connected to the exercise machine body at a position spaced from a perimeter of the magnetic resistance wheel and connected to the control unit, wherein the magnetic resistance member is pivoted to change an overlaying surface area of the at least one magnetic member of the first and second portions with respect to the magnetic resistance wheel to thereby vary a magnetic braking effect, the magnetic resistance wheel being spaced apart from the wind resistance unit by a distance in the axial direction of the rotating shaft to form an open moving space between the wind resistance unit and the magnetic resistance wheel, the open moving space being unobstructed during rotation of the magnetic resistance wheel, and the second portion of the magnetic resistance member being thereby selectively moveable into or away from the open moving space in an arcuate path intersecting a perimeter portion of the magnetic resistance wheel to adjust a magnetic resistance of the magnetic resistance wheel, wherein the second portion of the magnetic resistance member is in direct-adjacent relationship with respect to the plurality of blades of the wind resistance unit.

6. The exercise machine as claimed in claim 5, wherein a groove is formed on either one of the first portion or the second portion of the magnetic resistance member, and the second portion is movable in the open moving space when the groove is selectively moved into or out of the magnetic resistance wheel.

7. The exercise machine as claimed in claim 5, wherein a periphery of the turning disc has a plurality of engaging grooves each of which is recessed in the radial direction, each of the plurality of blades has a coupling end, the coupling end has an L-shaped notch and a fixing piece extending from a periphery of the L-shaped notch, the L-shaped notch and the fixing piece are formed by stamping, each of the plurality of blades further has an engaging block extending in the radial direction, the fixing piece of each of the plurality of blades is locked to the turning disc, and the engaging block of each of the plurality of blades is engaged in the respective engaging groove, each of the plurality of blades is thereby fixed to the turning disc.

* * * * *